United States Patent [19]

Schierling et al.

[11] Patent Number: 5,010,858

[45] Date of Patent: Apr. 30, 1991

[54] STARTER ARRANGEMENT FOR AN INTERNAL COMBUSTION ENGINE

[75] Inventors: Roland Schierling, Affalterbach; Hans-Peter Dohse, Kernen, both of Fed. Rep. of Germany

[73] Assignee: Andreas Stihl, Waiblingen, Fed. Rep. of Germany

[21] Appl. No.: 407,339

[22] Filed: Sep. 14, 1989

[30] Foreign Application Priority Data

Sep. 17, 1988 [DE] Fed. Rep. of Germany ..... 3831710

[51] Int. Cl.[5] ..... F02N 3/02; F02N 11/00

[52] U.S. Cl. ..... 123/179 P; 74/7 C; 74/7 E

[58] Field of Search ..... 123/179 P, 179 M, 179 SE; 74/7 C, 7 E, 625

[56] References Cited

U.S. PATENT DOCUMENTS

| | | | |
|---|---|---|---|
| 1,502,018 | 7/1924 | Chilton | 123/179 P |
| 2,939,448 | 6/1960 | Hansen | 123/179 P |
| 3,219,021 | 11/1965 | Mercer et al. | 123/179 P |
| 4,157,083 | 6/1979 | Smith et al. | 123/179 P |
| 4,848,288 | 7/1989 | Murase et al. | 123/179 P |
| 4,884,535 | 12/1989 | Iida et al. | 123/179 P |

*Primary Examiner*—Andrew M. Dolinar
*Attorney, Agent, or Firm*—Walter Ottesen

[57] ABSTRACT

The invention is directed to a starter arrangement for an internal combustion engine wherein a manual starter device is combined with an electrical starter. Handheld portable tools such as motor-driven chain saws, brush-cutters and the like are driven by two-stroke engines which can be started with a suitable manual starter device such as a pull-rope starter. Pull-rope starters require a forceful yank on the pull rope which is difficult for persons having inadequate physical strength. For this reason, electrical starters are provided to facilitate starting such handheld portable tools. The invention combines an electric starter and a manual starter device wherein the overrun clutch of the manual starter device includes a latching device and a drive member and is combined with a further latching device which coacts with a drive member driven by the electric starter. The engagement with the overrun clutch of the manual starter device makes possible a compact configuration so that the overall volume of the unmodified engine is not significantly increased notwithstanding the arrangement of the electric starter.

9 Claims, 1 Drawing Sheet

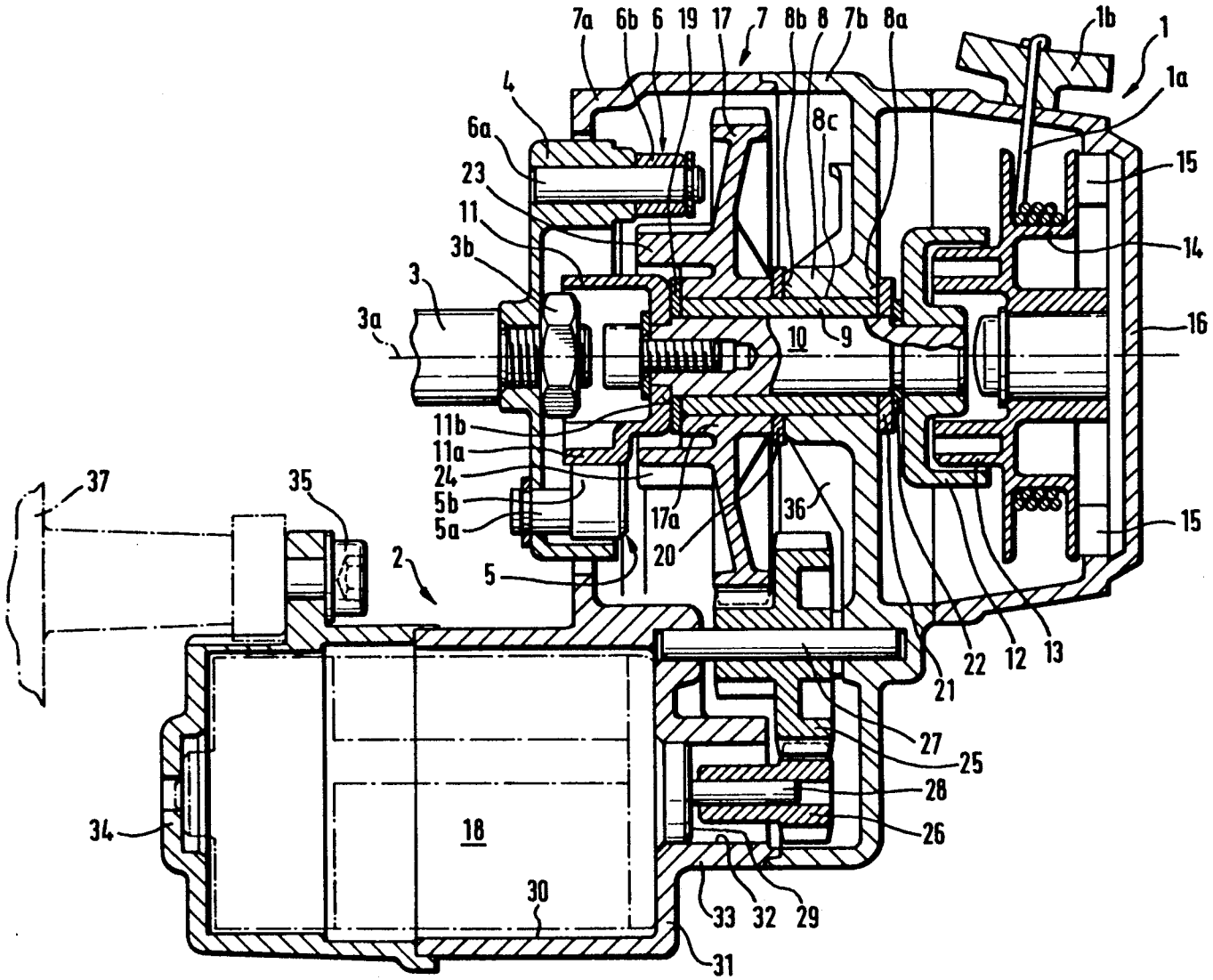
1
1a
1b
15
14
16
15
13
12
22
21
27
25
28
26
8a
7b
8
8b
7
17
19
6
6b
7a
8c
9
10
36
29
32
33
31
17a
20
5
30
18
4
6a
23
11
3b
3
3a
11b
11a
24
5b
5a
2
35
34
37

STARTER ARRANGEMENT FOR AN INTERNAL COMBUSTION ENGINE

FIELD OF THE INVENTION

The invention relates to a starter arrangement for an internal combustion engine such as a two-stroke engine especially for portable handheld tools such as motor-driven chain saws or the like.

BACKGROUND OF THE INVENTION

Starter arrangements of the kind referred to above as a rule comprise a pull-rope starter which includes a drum having the rope wound thereon. The rope must be pulled sharply and suddenly from the rope drum in order to obtain an adequate starting speed of the engine. This presents difficulties for persons having less physical strength since they are unable to yank the pull rope with sufficient force so that the engine driven via an overrun clutch does not reach the required starting speed.

In addition, electric starters are known which can be utilized in lieu of a manual starter device and operate on the crankshaft of the engine to be started via a gear multiplication. However, starters of this kind require considerable electrical power which can be made available independently of power mains only by means of appropriately large and heavy batteries.

With smaller batteries such as of the kind utilized in portable handheld tools, only a limited number of starting attempts are possible with an electrical starter. For this reason, it is desirable to supplement an electrical starter with a manual starter device for reasons of convenience and to ensure that the work tool can be made operational at the work location even if the batteries are exhausted.

In practice, only a limited number of work tools of a production series are equipped with an electrical starter which offers a high degree of comfort. It is therefore desirable to provide the electrical starter as an attachment so that the engine built into the work tool can be provided with a manual starter device as well as with a manual starter device combined with an electrical starter without the need for further modifications.

SUMMARY OF THE INVENTION

It is an object of the invention to combine a manual starter device with an electrical starter in such a manner that no changes are required on the engine. It is a further object of the invention to provide such a combination wherein the overall volume of the entire arrangement is kept as small as possible.

The starter arrangement of the invention is for an internal combustion engine, especially a two-stroke engine of a portable handheld tool such as a motor-driven chain saw or the like. The engine has a crankshaft and the starter arrangement includes: a housing; a manual starter device mounted in the housing; an electric starter motor; and, an overrun clutch assembly interposed between the crankshaft and the manual starter device as well as between the crankshaft and the electric starter motor. The overrun clutch assembly includes: a carrier fixedly mounted on the crankshaft so as to rotate therewith; a first drive member rotatably mounted in the housing and operatively connected to the manual starter device so as to be rotatable therewith; first latching means for connecting the first drive member to the carrier to rotate the carrier therewith so long as the first drive member rotates faster than the carrier and to disconnect the first drive member from the carrier as soon as the speed of the carrier exceeds the speed of the first drive member; a second drive member rotatably mounted in the housing and operatively connected to the electric starter motor so as to be rotatable therewith; and, second latching means for connecting the second drive member to the carrier to rotate the carrier therewith so long as the second drive member rotates faster than the carrier and to disconnect the second drive member from the carrier as soon as the speed of the carrier exceeds the speed of the second drive member.

According to a feature of the invention, the known overrun clutch arranged between the manual starter device and the crankshaft is expanded to an overrun clutch with two latching devices and two drive members corresponding to respective ones of the latching devices. This development permits the starter arrangement of the invention to have an overall length which is low measured in the axial direction of the crankshaft. The carrier is fixedly connected to the crankshaft so as to be rotatable therewith and has both latching devices. For this reason, the carrier which would otherwise be necessary for the latching device of the drive member of the electric motor is not needed.

BRIEF DESCRIPTION OF THE DRAWING

The invention will now be described with reference to the single figure of the drawing which shows a side elevation view, partially in section, of the starter arrangement according to the invention.

DESCRIPTION OF THE PREFERRED EMBODIMENTS OF THE INVENTION

The starter arrangement according to the invention comprises a combination of a manual starter device 1 and an electrical starter 2 with both engaging the crankshaft at one end thereof. The starter device of the invention is preferably disposed so as to lie opposite the power take-off of the crankshaft.

A circular carrier 4 is fixedly connected to the end of the crankshaft 3 so as to rotate therewith. In the embodiment shown, the carrier 4 is in the form of a cup-shaped hollow body. Two latching devices 5 and 6 are mounted on the side of the carrier 4 facing away from the crankshaft 3. The latching devices 5 and 6 are preferably disposed in the outer edge region of the carrier 4 so that they are diametrically opposite each other. The latching devices include respective pins 5*a* and 6*a* lying parallel to the crankshaft 3. The pins 5*a* and 6*a* have respective ends facing away from the crankshaft 3 on which respective latching pawls 5*b* and 6*b* are pivotally mounted. Each latching pawl 5*b* and 6*b* is resiliently biased in the direction of their engaging positions. In these engaging positions, the latching pawls 5*b* and 6*b* are orientated so that they are directed approximately radially inwardly with reference to the carrier 4.

The latching device 5 lies substantially within the cup-shaped hollow body defining the carrier 4 whereas the latching device 6 and especially the pawl 6*b* are disposed so as to be axially outside of the hollow body defining the carrier 4. The two latching devices 5 and 6 lie in planes parallel to each other and these planes are parallel to the base of the carrier 4. In this way, the latching device 5 of the manual starter device 1 is axially closer to the crankshaft 3 than the second latching device 6.

The cup shaped carrier 4 projects with its open end into a housing 7 which is essentially made up of a lower shell 7a and an upper shell 7b. A bearing portion 8 is provided in the upper shell 7b and is coaxial to the crankshaft axis 3a. The bearing portion 8 is configured to have a cylindrical bearing bore 8c in the upper shell 7b. A bearing bushing 9 is seated in the bearing portion 8 and rotatably journals an intermediate shaft 10. The intermediate shaft 10 carries a drive member 11 on its end facing toward the crankshaft 3 and this drive member 11 is fixedly connected to the intermediate shaft 10 so as to rotate therewith. In the same manner as the carrier 4, the drive member 11 is a cup-shaped hollow body which lies with its open end facing the end of the crankshaft 3 and partially surrounds a nut 3b threadably engaged with the free end of the crankshaft 3. The nut 3b fixedly attaches the carrier 4 to the crankshaft 3 so that the carrier rotates therewith.

The other end of the intermediate shaft 10 extends through the bearing bushing out of the housing 7 and carries a clutch drum 12 which is fixedly attached to the shaft 10 so as to rotate therewith. The clutch counter piece 13 of the drum 14 engages the clutch drum 12 and the drum 14 is part of a pull-rope starter defining the manual starter device. The clutch (12, 13) connects the drum 14 so that the latter is rotatably fixed to the intermediate shaft 10. The clutch counter piece 13 in combination with the one-piece drum 14 formed thereon can be axially removed from the clutch drum 12 to exchange a defective rope drum. In the engaged coupling position shown, the rope drum 14 is held by means of axial stops 15 which ar provided in a cover 16 securely seated on the upper shell 7b of the housing. The cover 16 covers the pull-rope starter 1.

The first drive member 11 includes at least one radial cam 11a which coacts with the pawl 5b of the latching device 5. With the latching device 5 engaged, the intermediate shaft 10 and therewith the pull-rope starter 1 are connected to the carrier 4 so as to rotate therewith and are therefore also connected to the crankshaft 3 in a manner so as to rotate therewith. The engine is started with a forceful pull on the pull rope 1a via the starter grip 1b. As soon as the engine starts up and the carrier 4 rotates faster than the drive member 11, the pawl 5b pivots about the pin 5a and overrides the cam 11a so that the drive member 11 is not entrained. The centrifugal force acting on the pawl 5b when the engine is running displaces the pawl into a disengaged position wherein a latch contact with the cams 11a is precluded.

The drive member 11 has a diameter greater than the outer diameter of the bearing bushing 9 so that the drive member 11 overlaps the outer diameter of the bearing bushing. The end face 11b of the drive member 11 faces toward the bearing bushing 9 and the end face 8b of the cylindrical bearing portion 8 lies opposite the end face 11b. A gear wheel 17 is mounted between this end face 11b and the end face 8b and defines the output gear wheel of a transmission driven by the starter motor 18.

The gear wheel 17 lies axially and free of play between the end face 8b of the cylindrical bearing portion 8 and the end face 11b of the drive member 11 which is achieved with intermediate discs 19 and 20 mounted at both ends of the bearing portion 17a of the gear wheel 17. The intermediate disc 19 between the first drive member 11 and the gear wheel 17 is disposed at the same time between the drive member 11 and the end face of the bearing bushing 9 facing toward the drive member 11.

The intermediate shaft 10 and the bearing bushing 9 are axially secured by an abutment disc 21 mounted on the end face 8a facing toward the coupling drum 12. The outer diameter of the abutment disc 21 is greater than the diameter of the bearing bore 8c. The abutment disc 21 is held in its position on the end 8a by means of a retaining ring 22 mounted on the intermediate shaft 10. The retaining ring is seated in a corresponding peripheral slot of the intermediate shaft 10.

A second drive member 23 is configured preferably as one piece with the output gear wheel 17. The drive member 23 corresponds to the second latching device 6 and comprises a cylindrical annular portion which extends in the direction toward the crankshaft 3 and partially surrounds the drive member 11. The annular portion 23 lies, when viewed in the axial direction, within the outer periphery of the carrier 4 and has a tooth configuration 24 on its outer side which coacts with the latching pawl 6b of the second latching device 6. The gear wheel 17 is configured as a spur gear that meshes with an intermediate gear wheel 25 and which, in turn, is driven by the pinion 26 of the electric starter motor 18. The intermediate wheel 25 is mounted on a pin 27 which is parallel to the intermediate shaft 10 and is journalled at its respective ends in the lower shell 7a and the upper shell 7b of the housing 7.

The lower shell 7a has a cup-shaped receptacle 30 lying parallel and in spaced relationship to the intermediate shaft 10. The receptacle 30 is open toward the motor and has a central opening 32 in the base 31 with the opening 32 facing the interior space of the housing 7. The opening 32 has a peripheral collar 33 formed on the base 31 and the collar 33 projects into the housing 7. The drive shaft 28 of the electric motor has a pinion 26 mounted thereon. The drive shaft 28 is pushed through the central opening 32 in the base to engage the pinion 26 with the intermediate gear wheel 25 and an attachment hub 29 of the motor is seated without play in the collar 33. The receptacle 30 is closed by a cover 34 which is preferably mounted on the engine, for example on its crankcase 37, by means of a screw 35.

When the starter motor rotates, the pinion 26, the intermediate gear wheel 25 and the output gear 17 are all rotated with the pawl 6b of the latching device 6 being in engagement with the teeth 24 so long as the output gear wheel 17 rotates as fast as the carrier 4 and the crankshaft 3 flange connected thereto. The motor then starts.

If the engine starts up and the speed of the carrier 4 increases above the speed of the output gear 17, the pawl 6b pivots about the pin 6a radially outwardly and so releases the connection between the output gear wheel 17 and the carrier 4 so that the gear wheel 17 is no longer connected to the crankshaft so as to rotate therewith. With increasing speed of the engine, the centrifugal force holds the pawl 6b in its disengaged position so that a further interaction between the running engine and the starter device is precluded.

The cylindrical bearing portion 8 of the housing 7 and the upper shell 7b is sufficiently long and made of an appropriately rigid material to ensure a secure seating of the bearing bushing 9 and thereby of the intermediate shaft 10 and of the output gear wheel 17. The cylindrical bearing portion 8 advantageously projects from the upper shell 7b into the housing 7 and is reinforced with reinforcing ribs 36 arranged on the inner wall surface of the upper shell *7b*.

It is understood that the foregoing description is that of the preferred embodiments of the invention and that various changes and modifications may be made thereto without departing from the spirit and scope of the invention as defined in the appended claims.

What is claimed is:

1. A starter arrangement for an internal combustion engine, especially a two-stroke engine of a portable handheld tool such as a motor-driven chain saw or the like, the engine having a crankshaft and the starter arrangement comprising:

a housing;

a manual starter device mounted in said housing;

an electric starter motor; and, an overrun clutch assembly interposed between the crankshaft and the manual starter device as well as between said crankshaft and said electric starter motor, the overrun clutch assembly including:

a carrier fixedly mounted on the crankshaft so as to rotate therewith;

a first drive member rotatably mounted in said housing and operatively connected to said manual starter device so as to be rotatable therewith;

first latching means for connecting said first drive member to said carrier to rotate said carrier therewith so long as said first drive member rotates faster than said carrier and to disconnect said first drive member from said carrier as soon as the speed of said carrier exceeds the speed of said first drive member;

a second drive member rotatably mounted in said housing and operatively connected to said electric starter motor so as to be rotatable therewith;

second latching means for connecting said second drive member to said carrier to rotate said carrier therewith so long as said second drive member rotates faster than said carrier and to disconnect said second drive member from said carrier as soon as the speed of said carrier exceeds the speed of said second drive member;

said overrun clutch further including rotating connecting means rotatably journalled in said housing for fixedly connecting said manual starter device to said first drive member so as to cause said first drive member to rotate with said manual starter device independently of said second drive member;

said second drive member being rotatably mounted in said housing so as to be rotatable relative to said rotating connecting means; and, said overrun clutch assembly further including torque transmitting means for interconnecting said second drive member and said starter motor so as to permit said starter motor to rotate said second drive member independently of said first drive member.

2. A starter arrangement for an internal combustion engine, especially a two-stroke engine of a portable handheld tool such as a motor-driven chain saw or the like, the engine having a crankshaft and the starter arrangement comprising:

a housing;

a manual starter device mounted in said housing;

an electric starter motor; and an overrun clutch assembly interposed between the crankshaft and the manual starter device as well as between said crankshaft and said electric starter motor, the overrun clutch assembly including:

a carrier fixedly mounted on the crankshaft so as to rotate therewith;

a first drive member rotatably mounted in said housing and operatively connected to said manual starter device so as to be rotatable therewith;

first latching means for connecting said first drive member to said carrier to rotate said carrier therewith so long as said first drive member rotates faster than said carrier and to disconnect said first drive member from said carrier as soon as the speed of said carrier exceeds the speed of said first drive member;

a second drive member rotatably mounted in said housing and operatively connected to said electric starter motor so as to be rotatable therewith;

second latching means for connecting said second drive member to said carrier to rotate said carrier therewith so long as said second drive member rotates faster than said carrier and to disconnect said second drive member from said carrier as soon as the speed of said carrier exceeds the speed of said second drive member;

said overrun clutch further including an intermediate shaft rotatably journalled in said housing for fixedly connecting said manual starter device to said first drive member so as to cause said first drive member to rotate with said manual starter device;

said second drive member having a gear means formed thereon and being rotatably mounted in said housing so as to be coaxial to said intermediate shaft and so as to be rotatable relative to said intermediate shaft; and, said overrun clutch assembly further including torque transmitting means for interconnecting said gear means of said second drive member and said starter motor so as to permit said starter motor to drive said second drive member.

3. The starter arrangement of claim 2, said first latching means and second latching means being mounted on said carrier so as to be arranged in respective mutually parallel planes.

4. The starter arrangement of claim 3, said carrier having a wall fixedly attached to the crankshaft so as to rotate therewith, said wall having a wall surface facing away from the crankshaft and said first latching means and said second latching means being mounted on said wall.

5. The starter arrangement of claim 4, the crankshaft defining a rotational axis and said first and second latching means being mounted on said wall surface so as to be diametrically opposite each other on respective sides of said axis.

6. The starter arrangement of claim 4, the crankshaft defining a rotational axis and having an outer end attached to said wall; and, said planes being perpendicular to said axis with said first plane being disposed closer to the outer end of said crankshaft than said second plane viewed in the direction of said axis.

7. The starter arrangement of claim 2, said second drive member being rotatably mounted on said housing so as to be coaxial with said first drive member; and, said second drive member having a cavity formed therein for receiving at least a portion of said first drive member therein.

8. The starter arrangement of claim 2, said overrun clutch including a bearing bushing seated in said housing for rotatably journalling said intermediate shaft therein; and, said bearing bushing having a segment thereof extending outwardly from said housing; and, said second drive member being rotatably mounted on said segment.

9. A starter arrangement for an internal combustion engine having a crankshaft, especially a two-stroke engine of a portable handheld tool such as a motor-driven chain saw or the like, the crankshaft of the engine defining a rotational axis and having an outer end, the starter arrangement comprising:

a housing;

a manual starter device mounted in said housing;

an electric starter motor; and, an overrun clutch assembly interposed between the crankshaft and the manual starter device as well as between said crankshaft and said electric starter motor, the overrun clutch assembly including:

a carrier fixedly mounted on the crankshaft so as to rotate therewith;

a first drive member rotatably mounted in said housing and operatively connected to said manual starter device so as to be rotatable therewith;

first latching means for connecting said first drive member to said carrier to rotate said carrier therewith so long as said first drive member rotates faster than said carrier and to disconnect said first drive member from said carrier as soon as the speed of said carrier exceeds the speed of said first drive member;

a second drive member rotatably mounted in said housing and operatively connected to said electric starter motor so as to be rotatable therewith;

second latching means for connecting said second drive member to said carrier to rotate said carrier therewith so long as said second drive member rotates faster than said carrier and to disconnect said second drive member from said carrier as soon as the speed of said carrier exceeds the speed of said second drive member;

said first latching means and second latching means being mounted on said carrier so as to be arranged in respective mutually parallel planes;

said carrier being a cup-shaped body having a base wall connected to the outer end of the crankshaft so as to be disposed coaxial to said axis; and, said first drive member extending at least partially into said cup-shaped body.

* * * * *